United States Patent [19]

Engel

[11] Patent Number: 4,813,256

[45] Date of Patent: Mar. 21, 1989

[54] APPARATUS FOR AXIALLY POSITIONING A ROLL OF A ROLLING MILL FOR MAKING A METAL PROFILE OR STEEL STRUCTURAL SHAPE

[75] Inventor: Georg Engel, Kaarst, Fed. Rep. of Germany

[73] Assignee: SMS Schloemann-Siemag Aktiengesellschaft, Dusseldorf, Fed. Rep. of Germany

[21] Appl. No.: 87,187

[22] Filed: Aug. 19, 1987

[30] Foreign Application Priority Data

Aug. 23, 1986 [DE] Fed. Rep. of Germany ..... 3628733

[51] Int. Cl.[4] ..... B21B 37/08; B21B 31/18; B21B 13/08

[52] U.S. Cl. ..... 72/21; 72/225; 72/245; 72/247

[58] Field of Search ..... 72/247, 245, 243, 21, 72/20, 225

[56] References Cited

U.S. PATENT DOCUMENTS 3,055,242 9/1962 Wilson ..... 72/247
4,202,192 5/1980 Haneda et al. ..... 72/247 X
4,203,310 5/1980 Krylov et al. ..... 72/247
4,400,957 8/1983 Carlstedt et al. ..... 72/243 X

FOREIGN PATENT DOCUMENTS 2440495 3/1975 Fed. Rep. of Germany .
3221346 12/1983 Fed. Rep. of Germany ..... 72/247
0969344 11/1982 U.S.S.R. ..... 72/247

*Primary Examiner*—Robert L. Spruill
*Assistant Examiner*—Steven B. Katz
*Attorney, Agent, or Firm*—Herbert Dubno

[57] ABSTRACT

To fix the relative axial position of a roll of a rolling mill and particularly with rolls of an unsymmetrical shape to improve the maintenance of tolerances for flange thicknesses of rolled sections at least one roll is provided with a double acting hydraulic cylinder for axial positioning by which the axial position is held fixed by an actual value-set value comparison by a control device. The actual value measurement of the axial position during a pass in which the rolls have changing axial forces should occur as close as possible to the rolled section for elimination of the position shifts due to compressibility or flexibility of components.

6 Claims, 2 Drawing Sheets

APPARATUS FOR AXIALLY POSITIONING A ROLL OF A ROLLING MILL FOR MAKING A METAL PROFILE OR STEEL STRUCTURAL SHAPE

FIELD OF THE INVENTION

My present invention relates to an apparatus for axially positioning a roll of a rolling mill which makes metal profile or steel structural shapes, especially steel profile or steel structural shapes.

BACKGROUND OF THE INVENTION

An apparatus for axially positioning a roll of a rolling mill is known comprising a hydraulic positioning means for the axially positioning at least one of the rolls of a roll pair and a control device for position control of the hydraulic positioning means to fix the axial position of the roll using a set point value/actual value comparison.

The setting and maintaining of a certain axial relative position of the cooperating rolls is of significance for rolling precision and the rectilinear course of the rolled material in regard to the axial forces arising in a roll pass, especially with an unsymmetrical profile of the workpiece. That is also true for the horizontal rolls of a universal rolling mill since the tolerances of the flange thickness of parallel mounted flanges can be disadvantageously effected by any relative axial shifting of the horizontal rolls. However tolerances must also be maintained for flange thicknesses in the rolling of bulkhead profile or steel structural shapes in a two high rolling mill.

Apart from manually operated axial positioning devices, these are known positioning mechanisms driven by an electric motor. One known axial positioning device engages on a journal block of a roll in which the roll is secured axially or on the roll itself which is axially movable in the radial bearing of the axially nonslidable supporting member. The positioning mechanism can engage also on a separate axial bearing and/or its bearing housing.

A disadvantage of the known axial positioning device for the rolls of a rolling mill for making a steel profile or steel structural shape is that it can be operated only between passes. The axial forces originating from the pass vary frequently just during rolling and, since the positioning apparatus must be supported in one roll stand, relative shifting is unavoidable during a roll pass because of compressibility in the roll and the positioning means.

The rolled material shape and the rolled material course can be undesirably influenced by an open roll design. This disadvantage can be compensated in rolling by unsymmetrically shaped rolls by a supporting collar or flange on the upper and the lower rolls which hold these rolls fixed in position relative to each other. Friction on the supporting collars however leads to higher energy and rolling costs. In recent years the field of slab rolling or flat rolling devices for axially shifting rolls opposite to each other have become known including double acting hydraulic cylinders which can be operated during rolling (German Pat. No. 24 40 495). This hydraulic axial positioning device has a higher flexibility with high axial forces on the rolls which may not be problematical in flat or slab rolling but cannot be tolerated in the rolling of structural shapes.

OBJECTS OF THE INVENTION

It is an object of my invention to provide an improved apparatus for axially positioning a roll of a rolling mill making a metal profile or steel structural shape, particularly a steel profile or steel structural shape which will be free from earlier drawbacks.

It is also an object of my invention to provide an improved apparatus for axially positioning a roll of a rolling mill making a metal profile or steel structural shape, particularly a steel profile or steel structural shape, which guarantees the fixing of the axial relative position of the rolls in a way other than by supporting collars at the roll ends.

It is another object of my invention to provide an improved apparatus for axially positioning the rolls of a rolling mill making a metal profile or steel structural shape, particularly a steel profile or steel structural shape, in which a more precise axial positioning is possible in a more economical way than has previously been possible despite the presence of comparatively high axial roll forces which are not present in flat or slab rolling.

SUMMARY OF THE INVENTION

These objects and others which will become more readily apparent hereinafter are attained in accordance with my invention in an apparatus for axially positioning a roll of a rolling mill for making a metal profile or steel structural shape, particularly a steel profile or steel structural shape, comprising a hydraulic positioning means for the axial positioning of at least one roll of a roll pair and a control device for position control of the hydraulic positioning means to fix the axial position of the roll using a set point value/actual value comparison.

According to my invention the determination of the actual value of the axial position occurs as close as possible to the metal profile or steel structural shape being rolled for the roll involved. Advantageously the hydraulic positioning means is a double acting hydraulic cylinder.

Stated otherwise my invention comprises a combination of at least one double acting hydraulic cylinder for axial positioning of at least one roll of a roll pair with an especially accurate control device for position regulation of the hydraulic cylinder for fixing the axial position of the one roll or both rolls using a setpoint/actual value comparison.

The axial positioning device used in the field of flat or slab rolling can be improved as described here with my invention. However it is sufficient to have only one roll of a roll pair of the rolling mill axially positionable or adjustable. All shifts of position due to compressibility or flexibility in the course of a pass through the mill with the axial forces of the rolls varying are eliminated by a control device for regulating the hydraulic cylinder or cylinder extension.

The layout of the electronics for regulating the hydraulic cylinder, the response time of the control device and the actual value measurement in the sense of a quick correction of variations from a preset axial relative position of the rolls can all present improvements in accordance with the invention. The actual value determination of the axial position of one or both rolls should occur as close as possible to the rolled profile or steel structural shape so that axial deformations of one or both rolls and their axial mounting piece are eliminated as factors by control of the axial position during rolling.

The actual value measurement of the axial position of one or both rolls can advantageously occur directly without contact at the ends of the roll body or bodies, e.g. using contactless or proximity sensors. Thus the actual value measurement is appropriately related to a fixed reference surface, however it can be related also to deviations of both rolls in their axial positions.

Advantageously an actual value measurement of the axial position of a radially unadjustable roll, usually the lower roll, is made by an actual value position transmitter which is attached to the surfaces of a roll stand facing the roll assembly and whose movable measuring member is connected with the closest journal block following the axial motion of the roll.

Within the scope of my invention the actual value measurement of the axial position of the roll can be effected by a profile or steel structural shape thickness measurement on the rolling rolled profile or steel structural shape, and of course by measurement of the thickness of the flange or flanges, for example of a bulkhead profile or steel structural shape, whose thickness or thicknesses depend on the axial position of the rolls.

For radially nonadjustable rolls an axial positioning device is sufficient with the hydraulic cylinder positioned only on one operating said concentric to the roll. It is advantageously pivotally mounted in mounting pieces because of the expected roll bending forces. The hydraulic cylinder can be positioned on the operating side on a piston rod concentric to the roll which is connected with the bearing housing of a separate axial bearing of the roll so that the hydraulic cylinder can be pivotally mounted by two diametrically opposed substantially horizontal pivot pins in two mounting pieces and so that the mounting pieces can be detachably secured in the associated roll stand without play. The connection of the mounting pieces with the associated roll stand with free play assumes the horizontal fixing of the roll and acts to minimize the possible variations of the axial relative position of the rolls.

As is known the mounting pieces must be attached releasably with the roll stand for exchange or replacement of the rolls. Also the piston rod of the hydraulic cylinder which is positioned concentric to the roll can be shaped in an easy way to conform to the bearing cover held on the housing side of the separate axial bearing.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
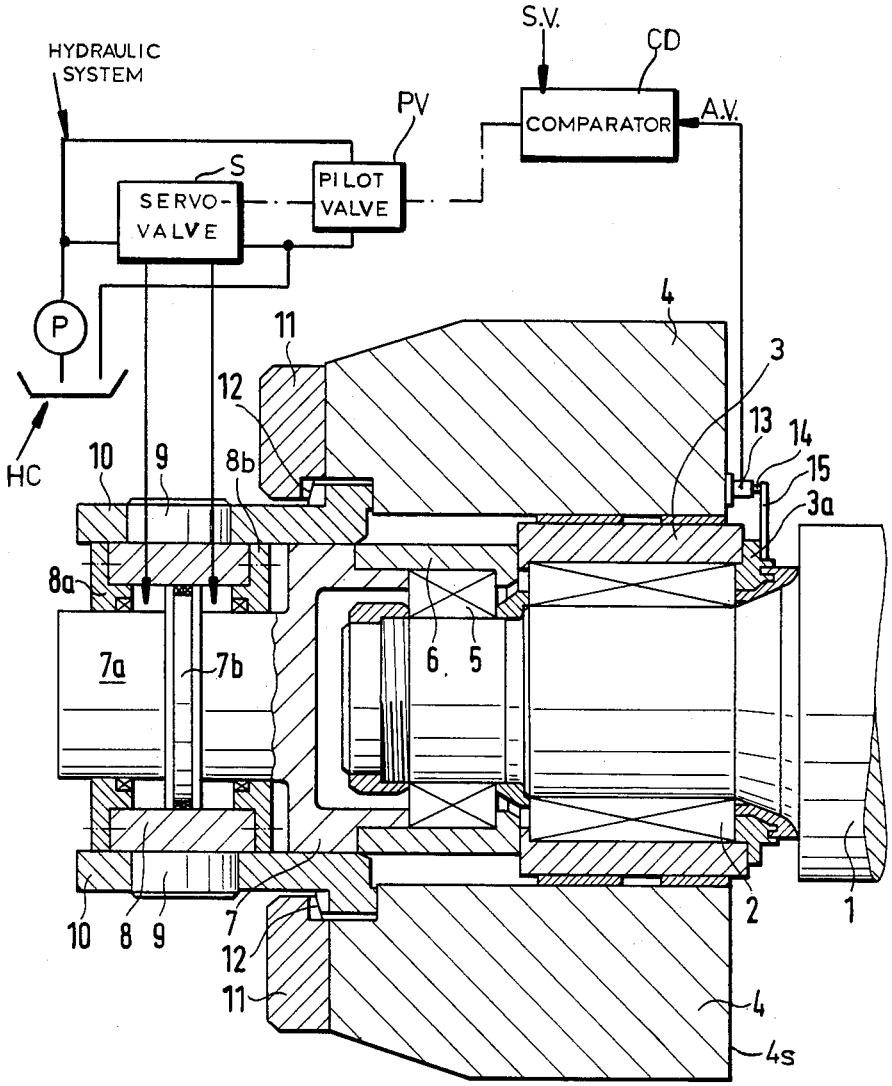
FIG. 1 is a horizontal cross profile or steel structural shape through a roll of a rolling mill equipped with an apparatus for axially positioning and holding the roll according to my invention.
Figure 2:
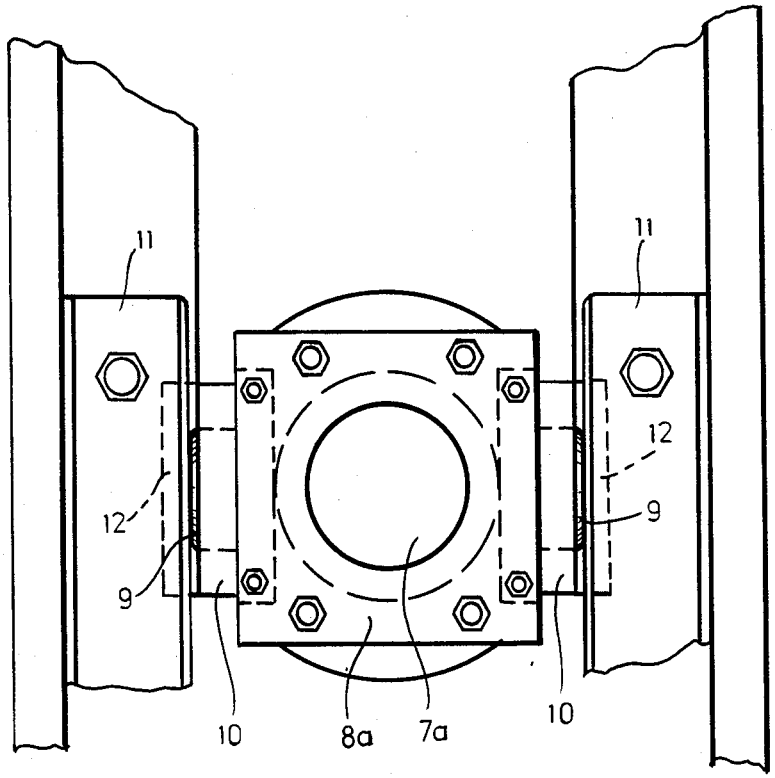
FIG. 2 is a side view of this apparatus.

The apparatus of my invention is illustrated in FIGS. 1 and 2 which show the operating side of a bearing of a profiled roll 1.

The roll 1 is rotatably mounted in a radial bearing 2 which is located in a journal block 3. The journal block 3 is guided axially slidable in the window opening of a roll stand 4.

A separate axial bearing 5 is held in a bearing housing 6 by a removable bearing cover 7 on which is formed a piston rod 7*a* concentric to the roll 1 which carries a rotary piston 7*b*. The double acting hydraulic cylinder 8 is thus concentrically positioned relative to the roll 1 and is closed by the cylinder covers 8*a* and 8*b*. Cylinder 8 has two diametrically opposed pivot pins 9 extending horizontally by which it is pivotally mounted in two mounting pieces 10 to follow any bending of the roll 1. Mounting piece strips 11 are releasably mounted in the roll stand 4 which support and engage a pair of wedge pieces 12 by which the mounting pieces 10 are held without play in the roll stand 4.

To axially mount the roll 1 together with the bearing and hydraulic cylinder 8, the wedge pieces 12 are loosened and the mounting piece strips 11 are removed.

A position transmitter 13 acts to determine the actual position value. It is attached to the surface 4*s* of the roll stand 4 facing the roll assembly and its movable measuring member 14 is connected by a strap 15 with the bearing cover 3*a* of the journal block 3.

The actual value measurement thus is taken in the immediate vicinity of one end of the roll 1 so that all deformations are eliminated including the compressibility of the hydraulic compressing medium which act left from the bearing cover 8*a* up to the mounting piece 10 supported play-free in the roll stand 4 and/or in the mounting piece strips 11 for the electronic position regulation, which includes understandably the set position transmitter.

The hydraulic positioning means is a means which extends itself or contracts itself when a compressible or hydraulic medium acts on it which is engaged with said axially shiftable roll so that its position can be changed by extension or contraction of the hydraulic positioning means. In this example it comprises the double acting hydraulic cylinder 8.

By the "roll assembly" of a roll referred to in the following claims I mean the roll and the various bearings 2 and 5, journal block 3 and other parts used to mount the roll in the window of the roll stand.

The control system includes the comparator CD receiving the actual value signal A.V. from the transmitter 13 and a setpoint value S.V. Control device CD then sends an error signal, if there is a significant difference between the actual vale and the setpoint, to an electrically controlled element such as a pilot value PV controlling the servovalve s in a hydraulic circuit HC which allows an incompressible medium to flow to the hydraulic cylinder 8 in one or the other direction thus changing the position of the piston and the axially shiftable roll 1.

The measuring member 14 measures the axial position of the roll 1 relative to the surface 4*s* on which it is mounted. Thus the position measurement is made relative to this fixed roll stand surface 4*s* in this example. However within the scope of my invention it is also possible to make the measurement of the position of one roll relative to the other roll in a pair of rolls which cooperate with each other.

I claim:

1. An apparatus for axially positioning a roll of a rolling mill for rolling a metal profile having at least one flange, comprising:

a roll assembly comprising an axial thrust bearing and a radial bearing, said radial bearing disposed at one end of the roll separated from said thrust bearing;

a bearing housing covering said axial bearing;

a mill stand supporting said roll;

an actual value position transmitter for sensing an actual position of said roll, said transmitter being adjacent a surface of said mill stand facing said one end of the roll and functioning to detect the axial position of the roll in comparison to said surface which serves as a reference surface;

a double acting hydraulic cylinder containing a pressure medium and being concentric to the roll, said cylinder secured to said mill stand and having a piston of said cylinder attached to said separated axial bearing;

a control device for position control of said hydraulic cylinder and roll, said device communicating with said cylinder and roll through a means which compares a set point value to said actual value; and wherein said transmitter and said double acting cylinder are located on a same side of said roll assembly, said transmitter positioned between said cylinder and an area of the roll contacted by the metal profile, thereby at least minimizing for said control device any influence of compressibility of flexibility within said roll, bearings and pressure medium resulting from variations in axial forces during rolling.

2. An apparatus according to claim 1 wherein said hydraulic cylinder is pivotally mounted by two horizontal pivot pins in two mounting pieces, said pieces being detachably secured without free play in said roll stand.

3. An apparatus according to claim 2 wherein the piston rod is formed on said bearing housing covering said axial bearing.

4. An apparatus according to claim 2 wherein said roll stand is on a service side of the rolling mill.

5. An apparatus according to claim 1 wherein the transmitter has a movable measuring member connected to a journal block closest to said member, said block following the axial motion of said roll.

6. An apparatus according to claim 1 wherein the transmitter is of the contactless sensor type.

* * * * *